US009787027B2

(12) United States Patent
Liu

(10) Patent No.: US 9,787,027 B2
(45) Date of Patent: Oct. 10, 2017

(54) POWER PLUG CONNECTOR CAN BE PLUGGED IN BOTH NORMAL AND REVERSE WAY

(71) Applicant: Hong-Mei Liu, Xiamen (CN)

(72) Inventor: Hong-Mei Liu, Xiamen (CN)

( * ) Notice: Subject to any disclaimer, the term of this patent is extended or adjusted under 35 U.S.C. 154(b) by 0 days.

(21) Appl. No.: 14/907,291

(22) PCT Filed: Jan. 21, 2015

(86) PCT No.: PCT/CN2015/071197
§ 371 (c)(1),
(2) Date: Jan. 25, 2016

(87) PCT Pub. No.: WO2016/115692
PCT Pub. Date: Jul. 28, 2016

(65) Prior Publication Data

US 2016/0372871 A1 Dec. 22, 2016

(51) Int. Cl.

| | |
|---|---|
| ***H01R 13/642*** | (2006.01) |
| ***H01R 13/405*** | (2006.01) |
| ***H01R 13/502*** | (2006.01) |
| ***H01R 13/66*** | (2006.01) |
| ***H01R 13/05*** | (2006.01) |
| ***H01R 13/26*** | (2006.01) |
| ***H01R 13/6581*** | (2011.01) |

(Continued)

(52) U.S. Cl.
CPC ..... *H01R 13/642* (2013.01); *H01R 13/05* (2013.01); *H01R 13/26* (2013.01); *H01R 13/405* (2013.01); *H01R 13/502* (2013.01); *H01R 13/6581* (2013.01); *H01R 13/665* (2013.01); *H01R 13/6658* (2013.01); *H01R 24/60* (2013.01); *H01R 27/00* (2013.01); *H01R 2107/00* (2013.01)

(58) Field of Classification Search
CPC ..... H01R 12/18; H01R 12/721; H01R 13/02; H01R 13/46; H01R 13/631; H01R 13/64; H01R 13/6315; H01R 13/642; H01R 13/05; H01R 13/26; H01R 13/5681; H01R 13/6658; H01R 13/665; H01R 13/405; H01R 24/60; H01R 2107/00; H01R 27/00
USPC ..... 439/218
See application file for complete search history.

(56) References Cited

U.S. PATENT DOCUMENTS

| | | | | |
|---|---|---|---|---|
| 7,081,003 | B1 * | 7/2006 | Gregori | H01R 13/516 439/352 |
| 7,094,086 | B2 * | 8/2006 | Teicher | H01R 27/00 439/173 |

(Continued)

*Primary Examiner* — Edwin A. Leon
*Assistant Examiner* — Milagros Jeancharles

(57) ABSTRACT

A power plug connector capable of being plugged in both normal and reverse way, comprising an insulator, a soft tongue plate, a plurality of first terminals and second terminals, and a shielding case; by fixing the soft tongue upon the insulator, the front end of the soft tongue being suspended inside the insertion slot; every rear end of the second terminals respectively connected with the corresponding rear ends of the first terminals; When plug normally, the power plug connector can be smoothly plugged-in, and the first terminals contacts the power socket connector; When plug reversely, the soft tongue plate will bend which allows the product to continue inserting, so the multiple terminals can connect the power socket connector and conducts, thereby realizing normal and reverse plug and avoiding wear and damage to the power plug connector.

9 Claims, 20 Drawing Sheets

Figure 1:
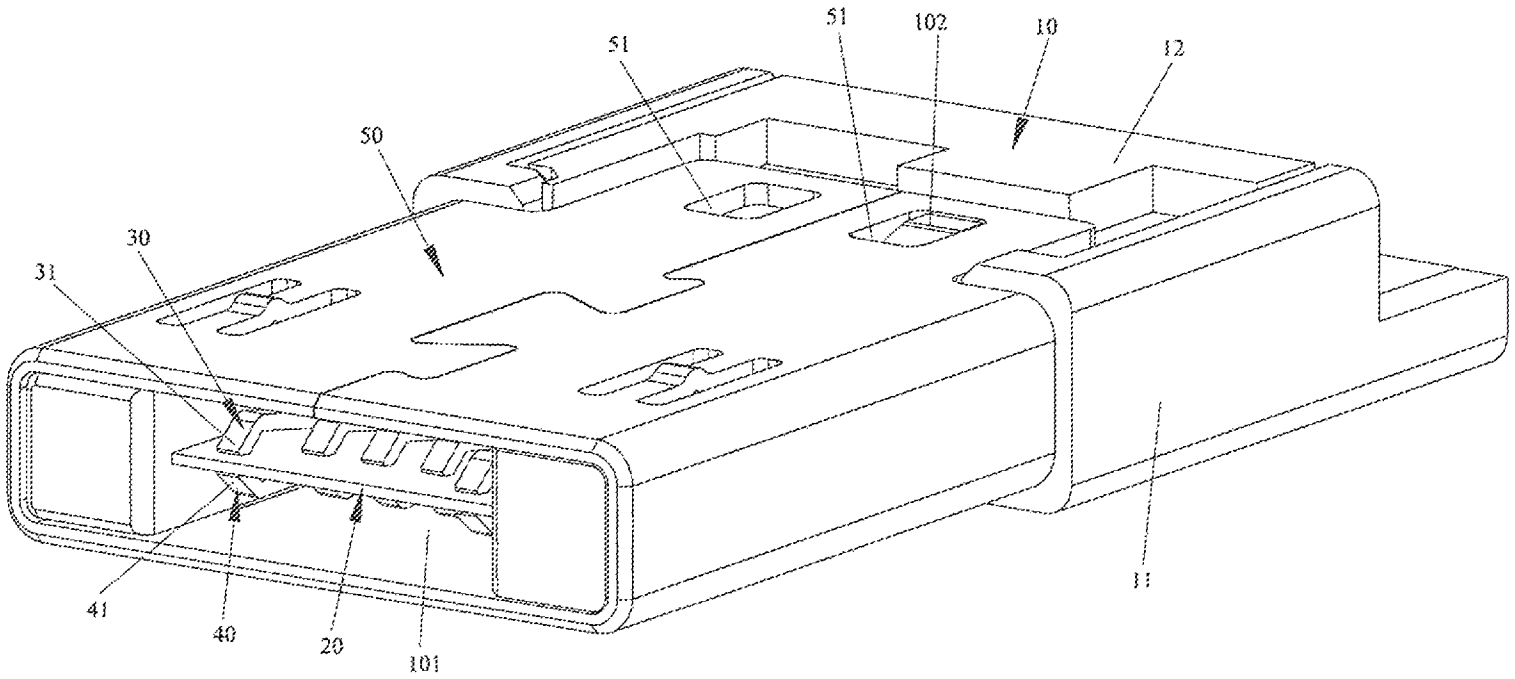
Figure 2:
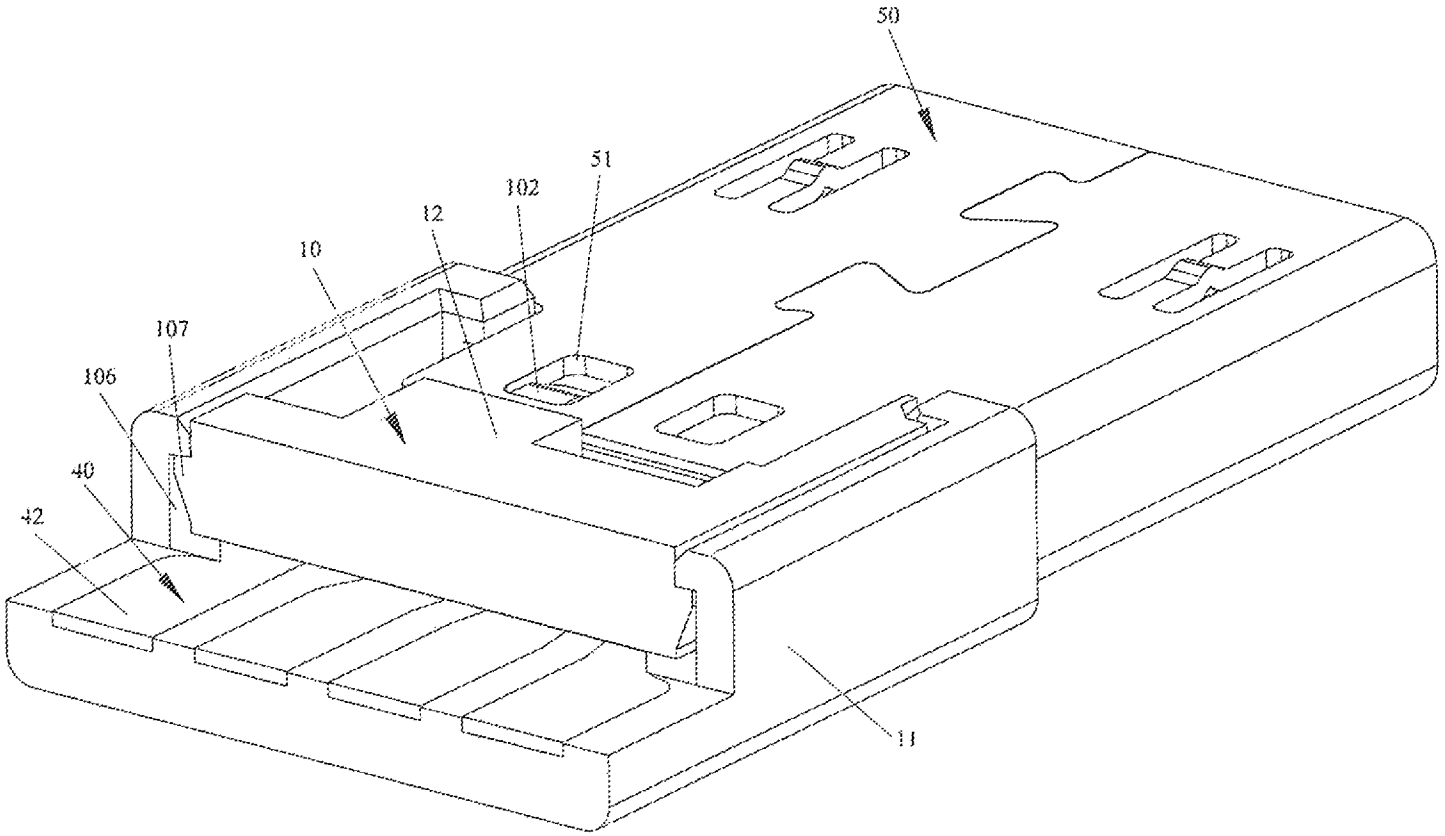
Figure 3:
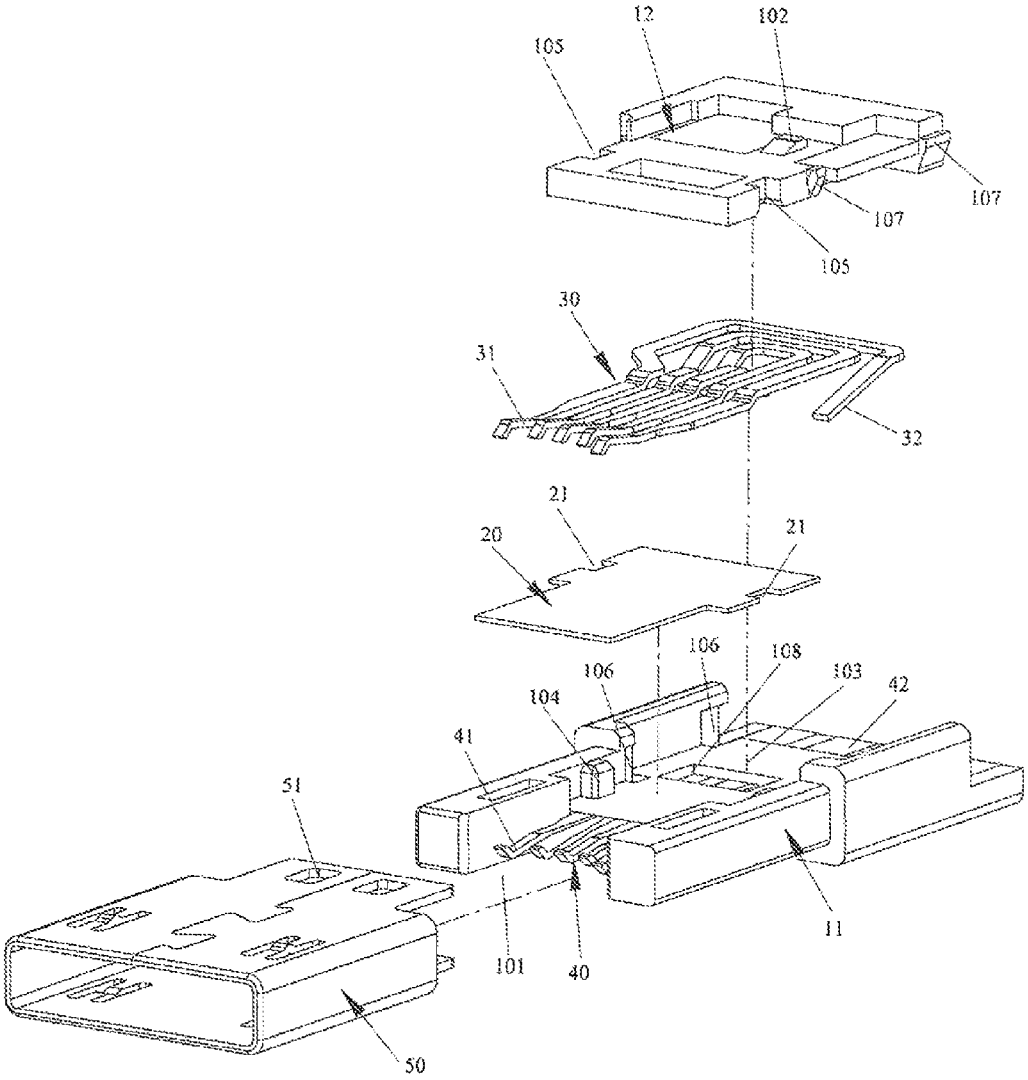
Figure 4:
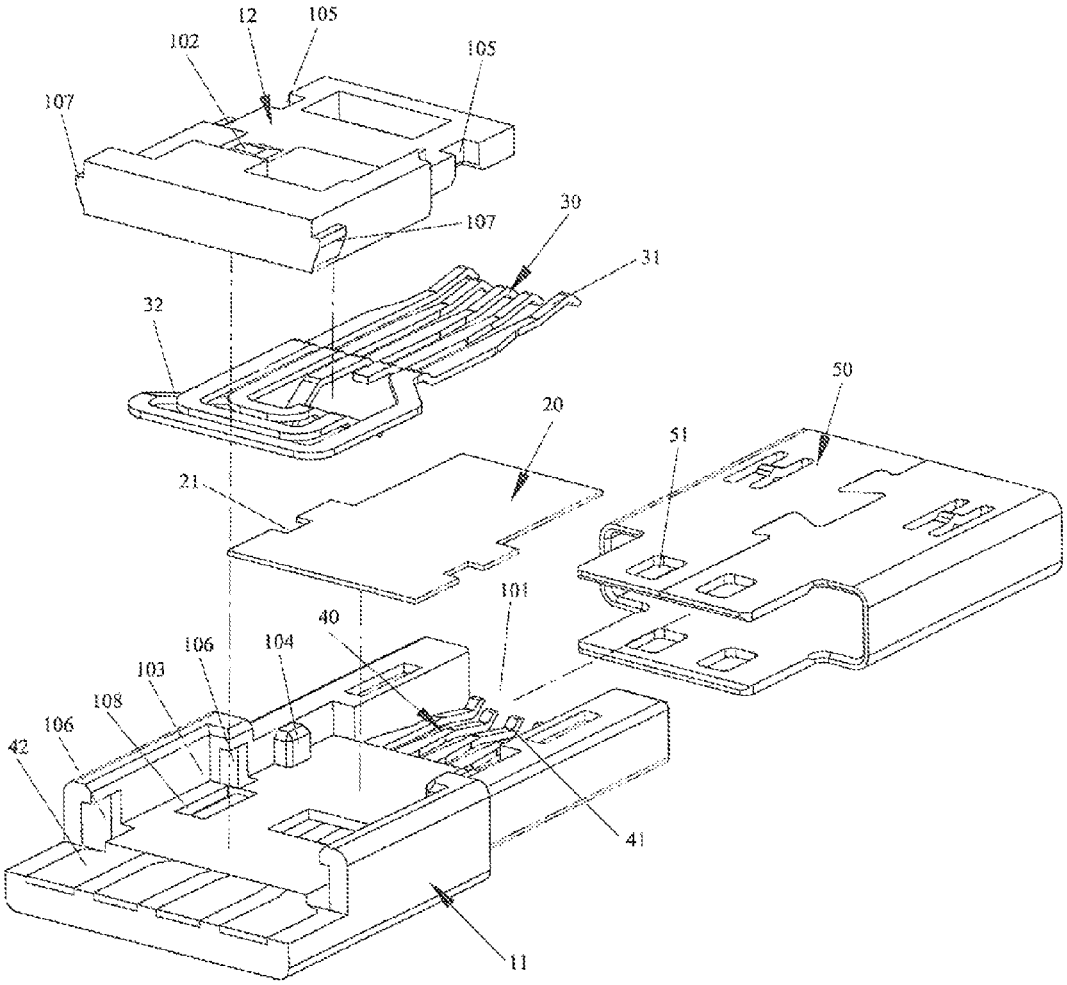
Figure 5:
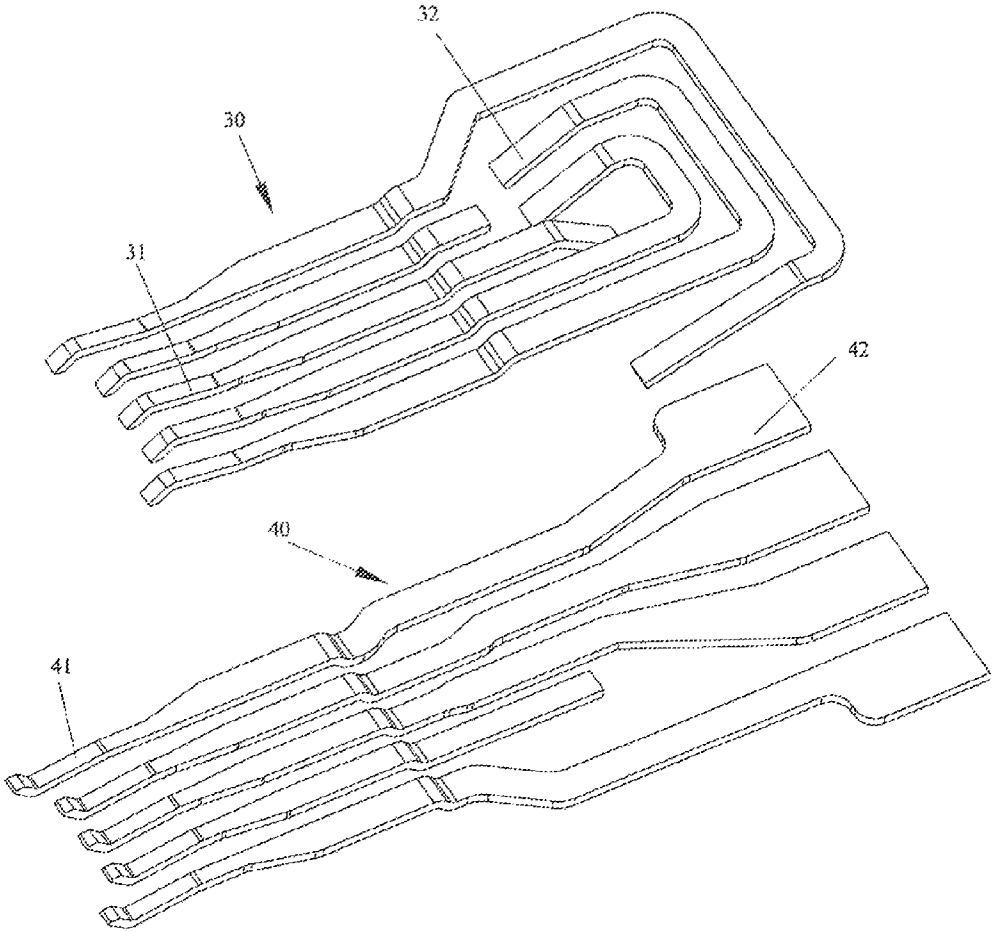
Figure 6:
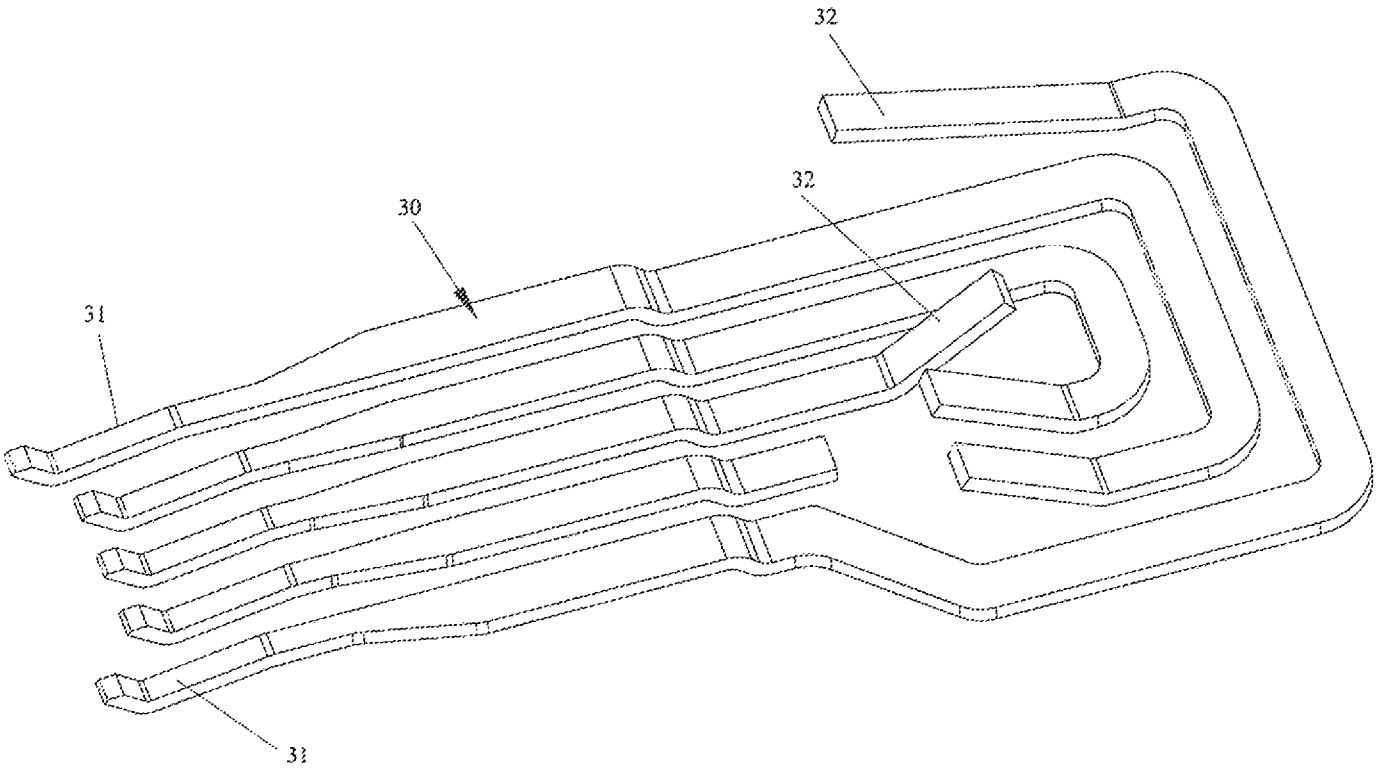
Figure 7:
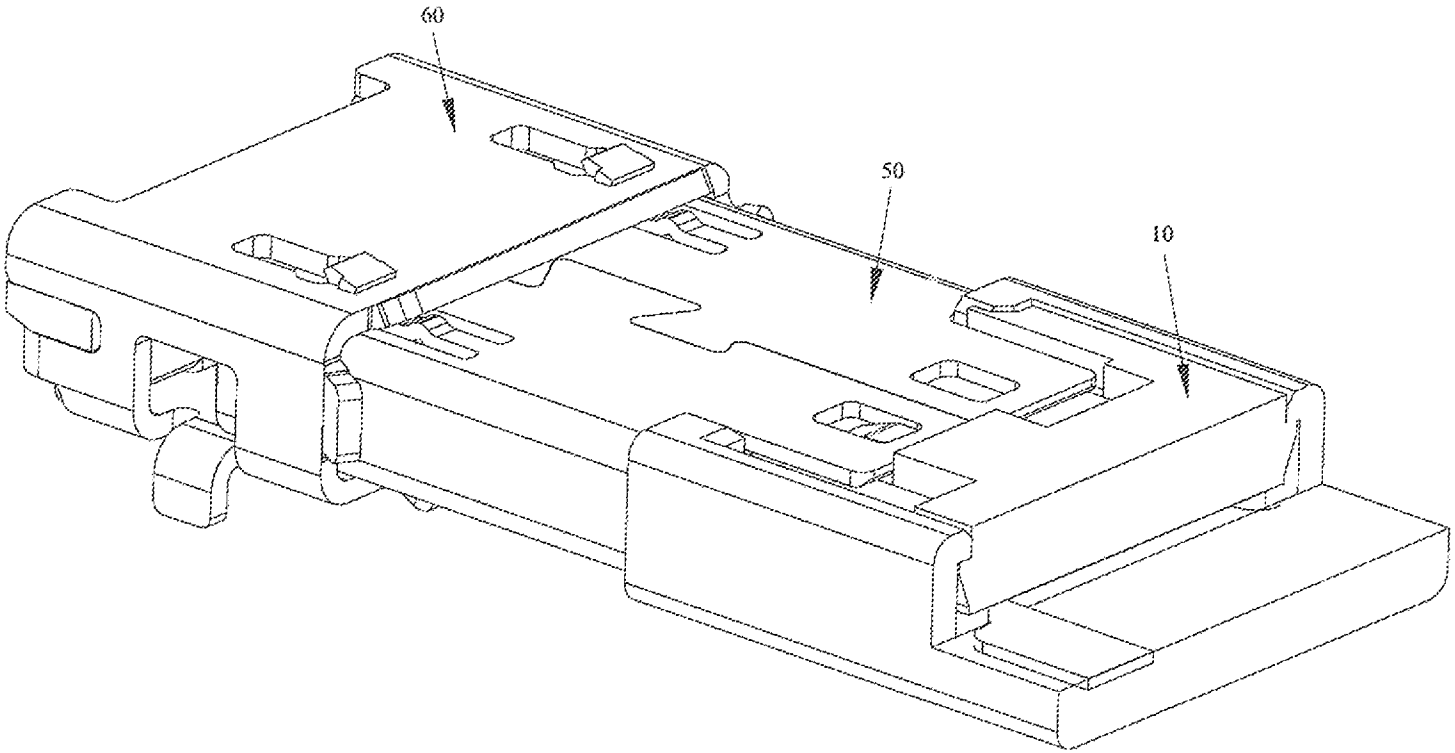
Figure 8:
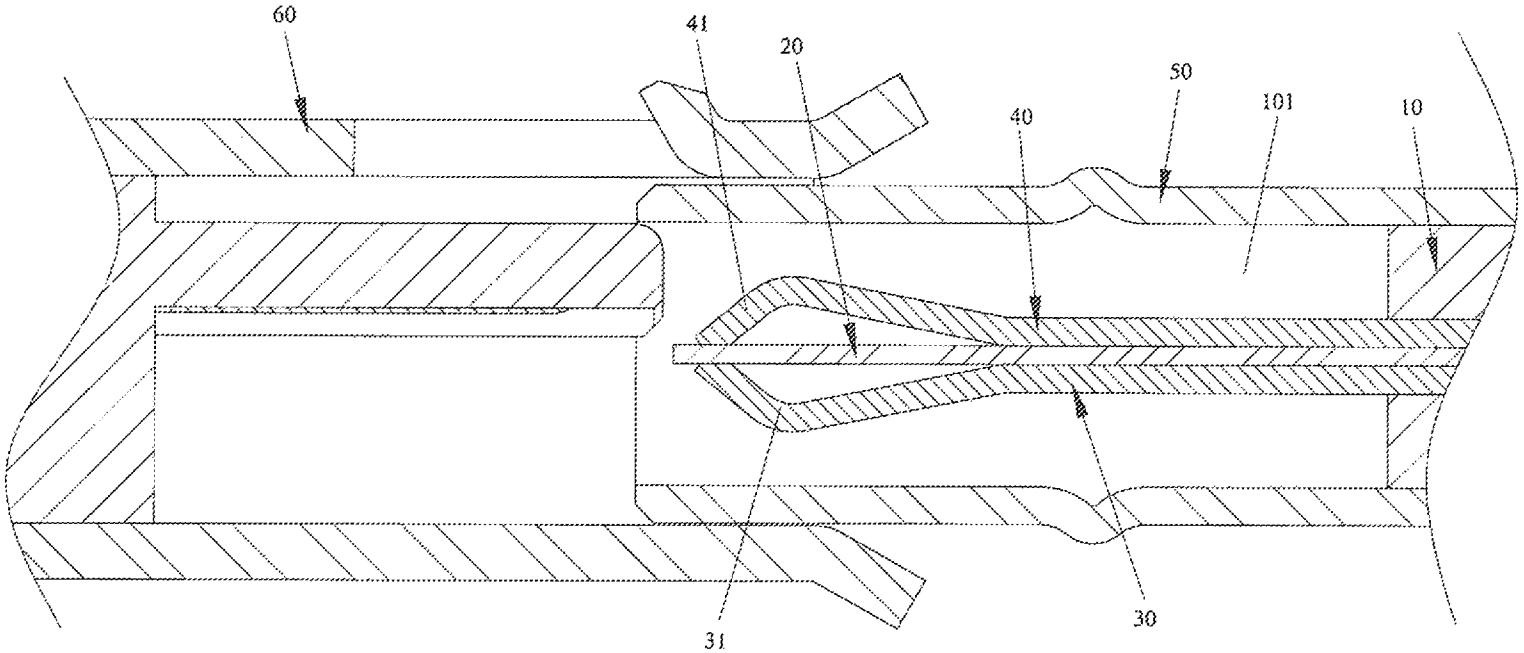
Figure 9:
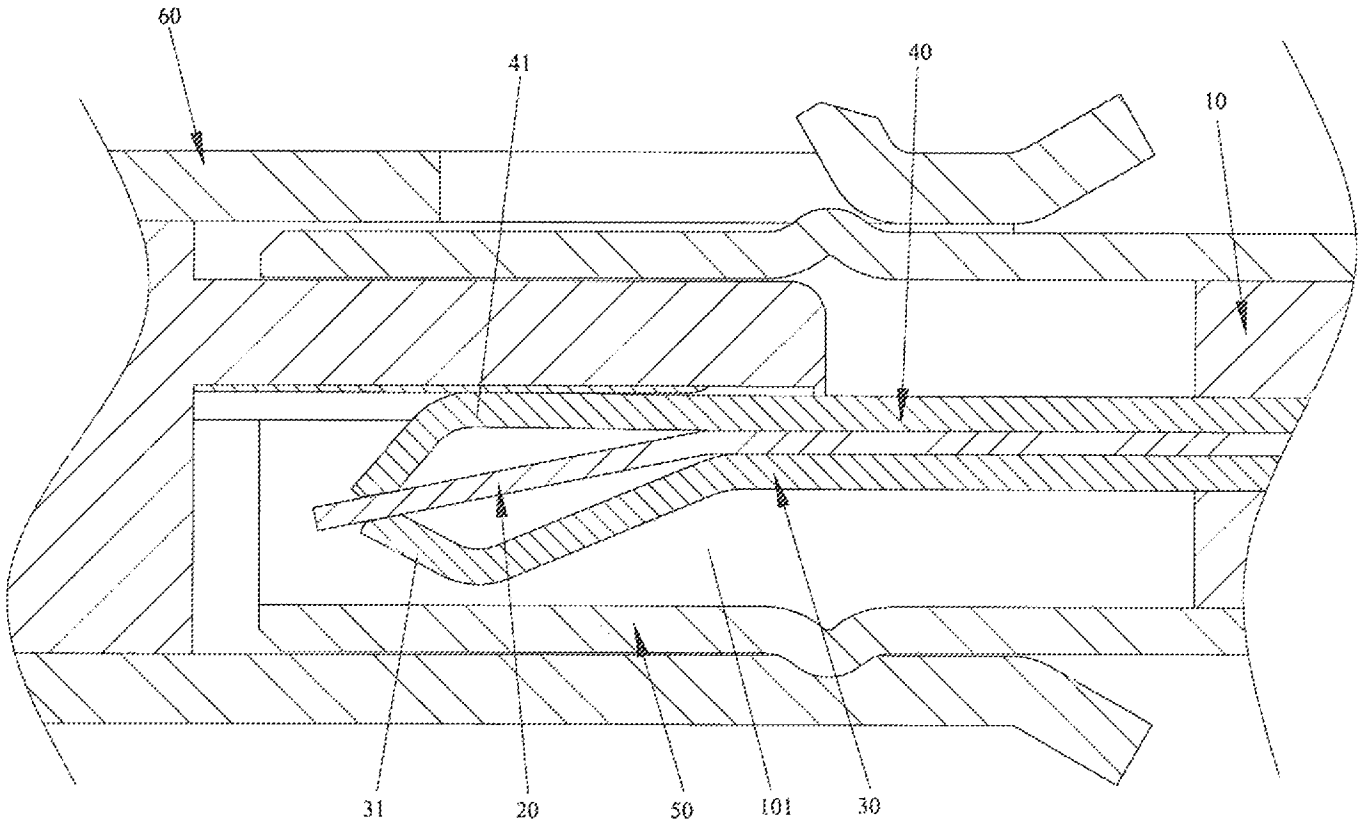
Figure 10:
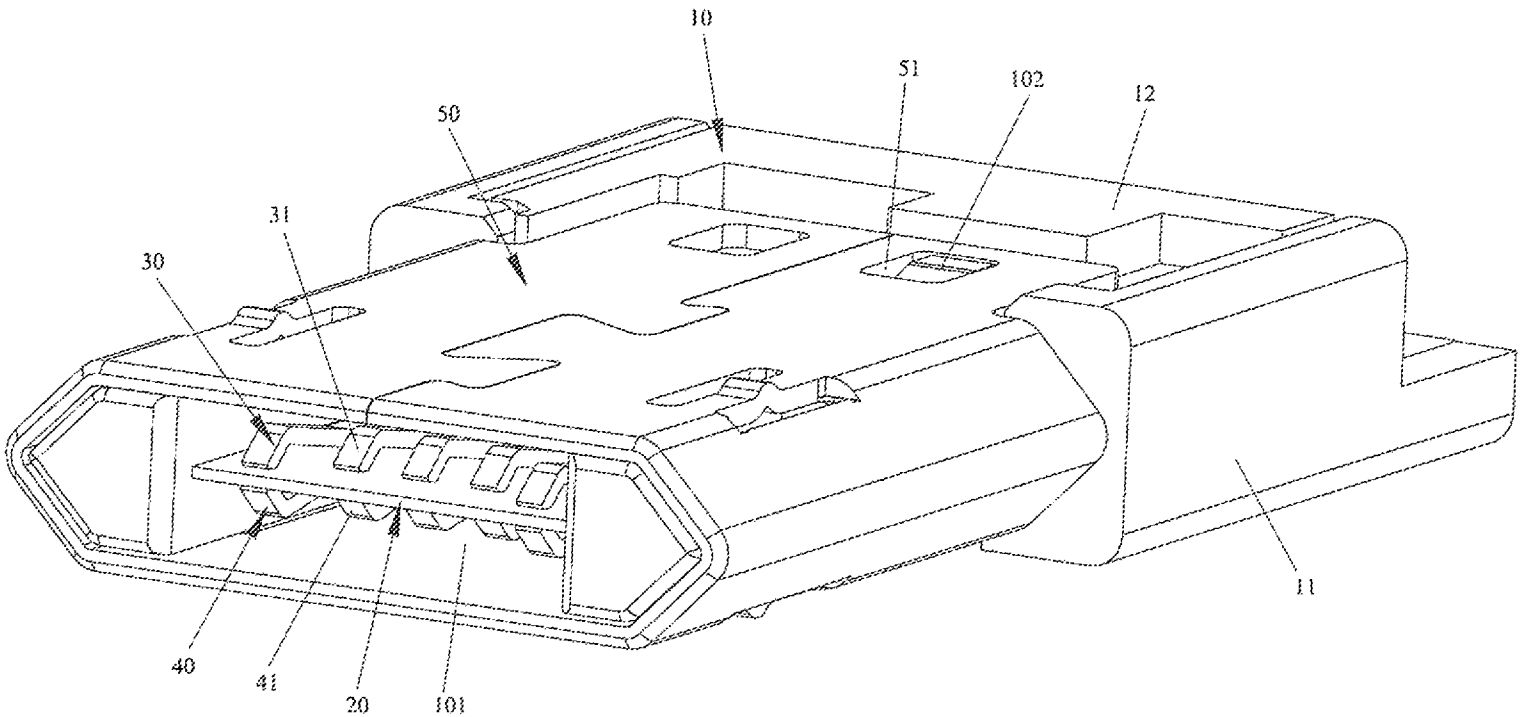
Figure 11:
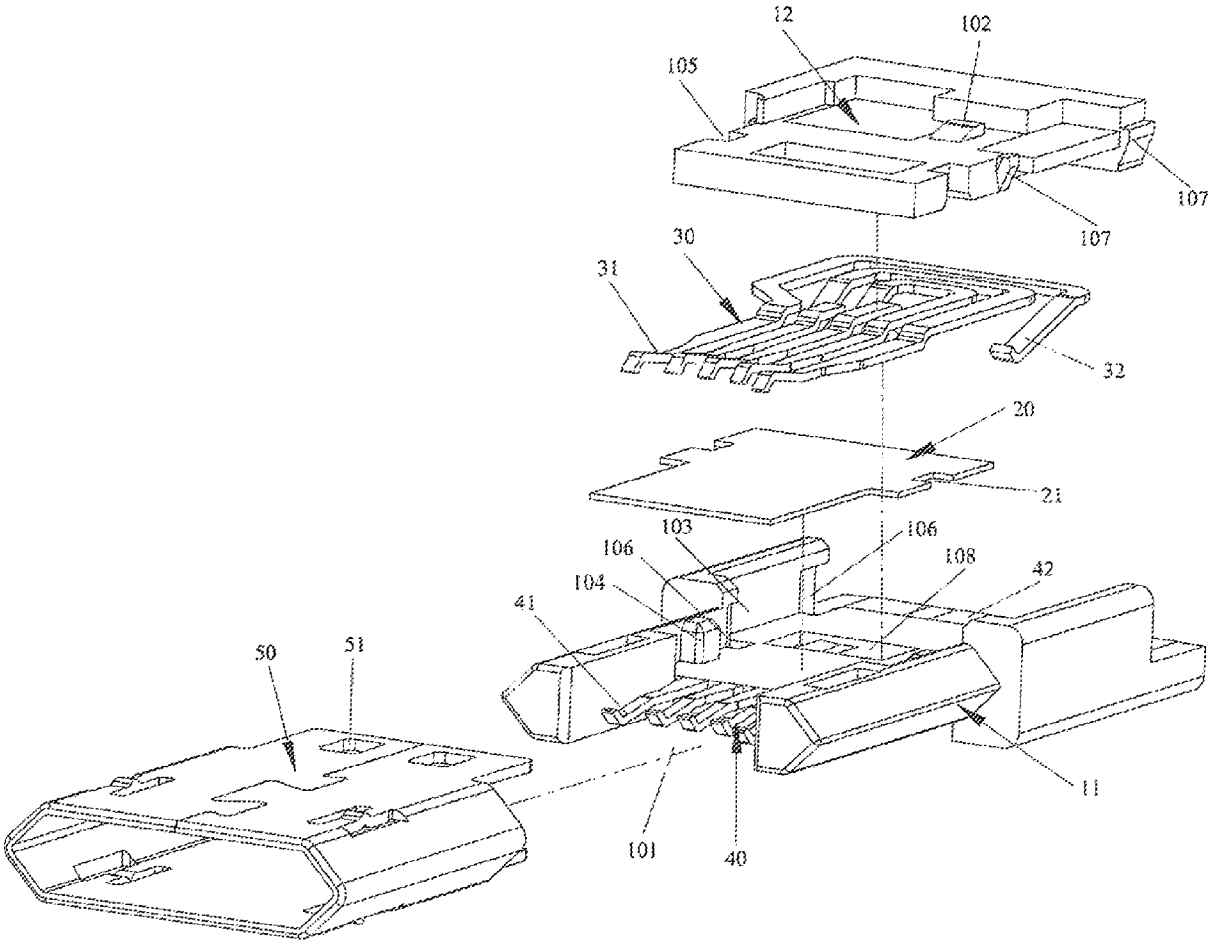
Figure 12:
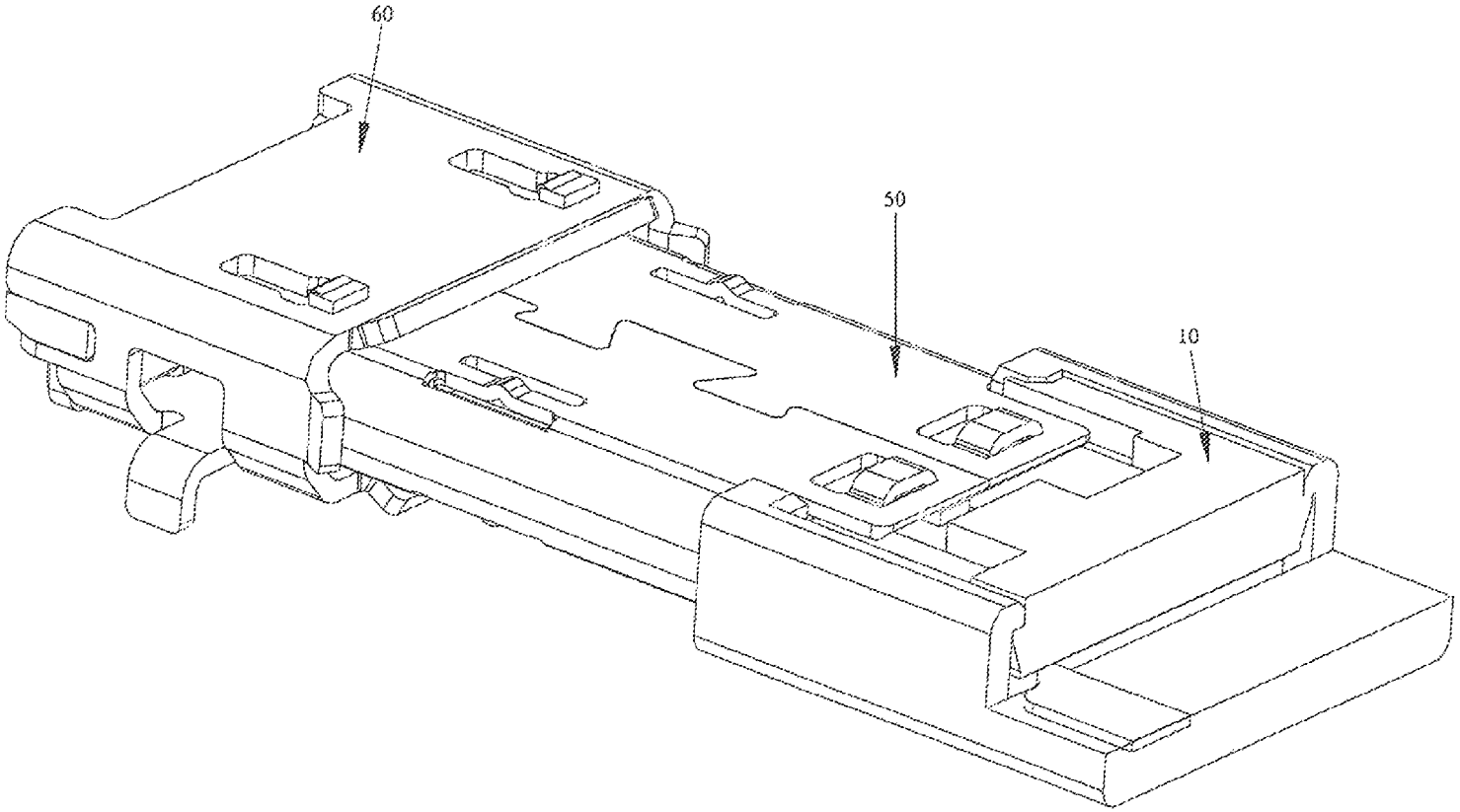
Figure 13:
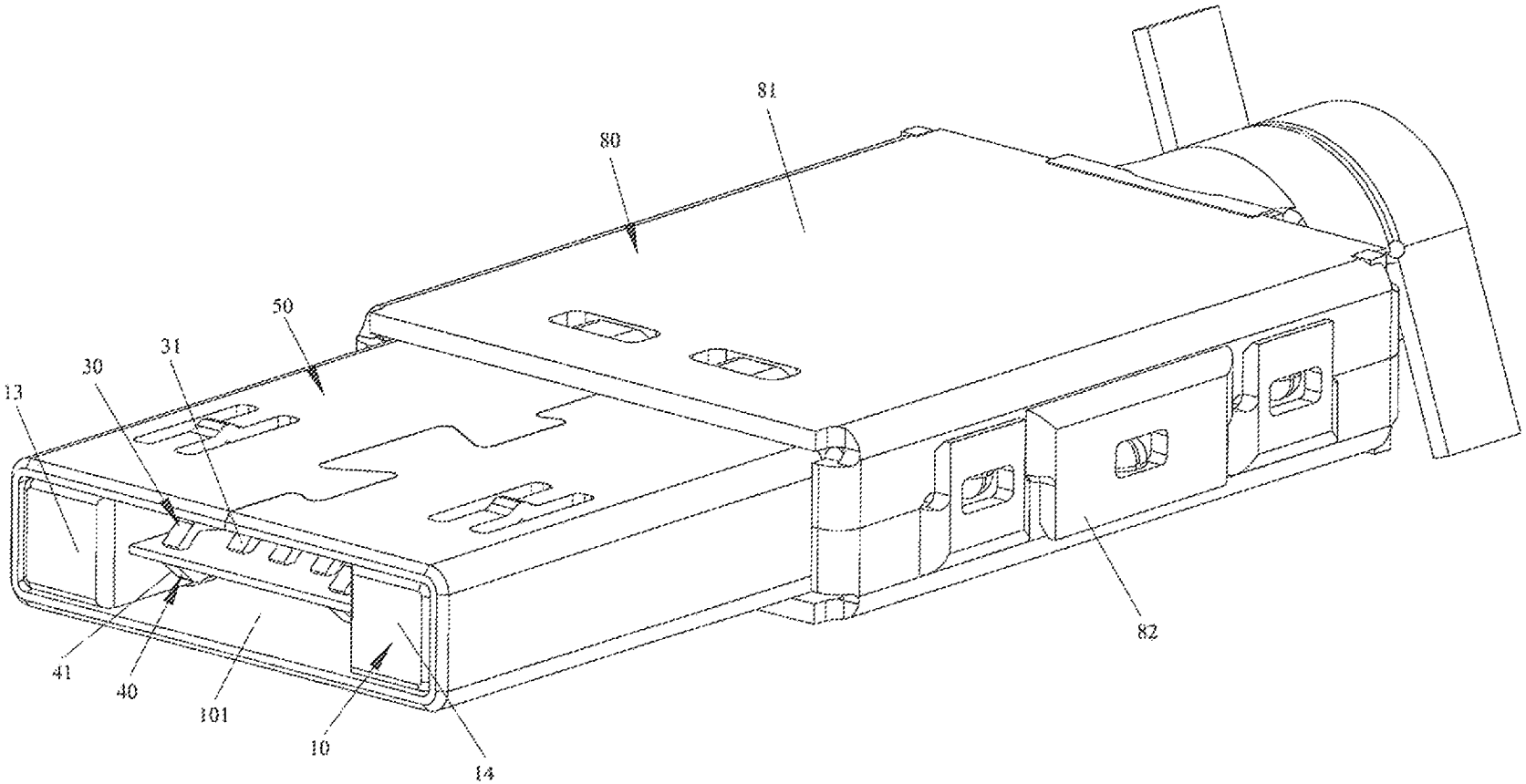
Figure 14:
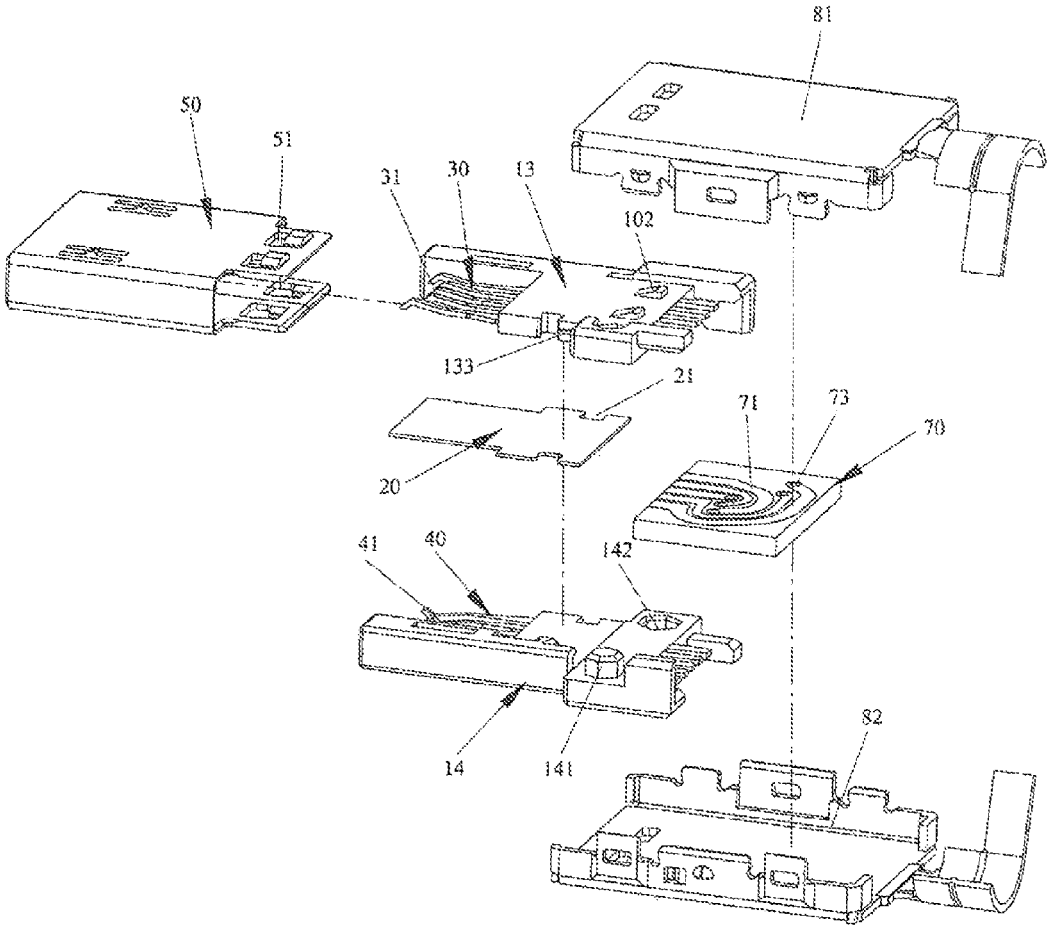
Figure 15:
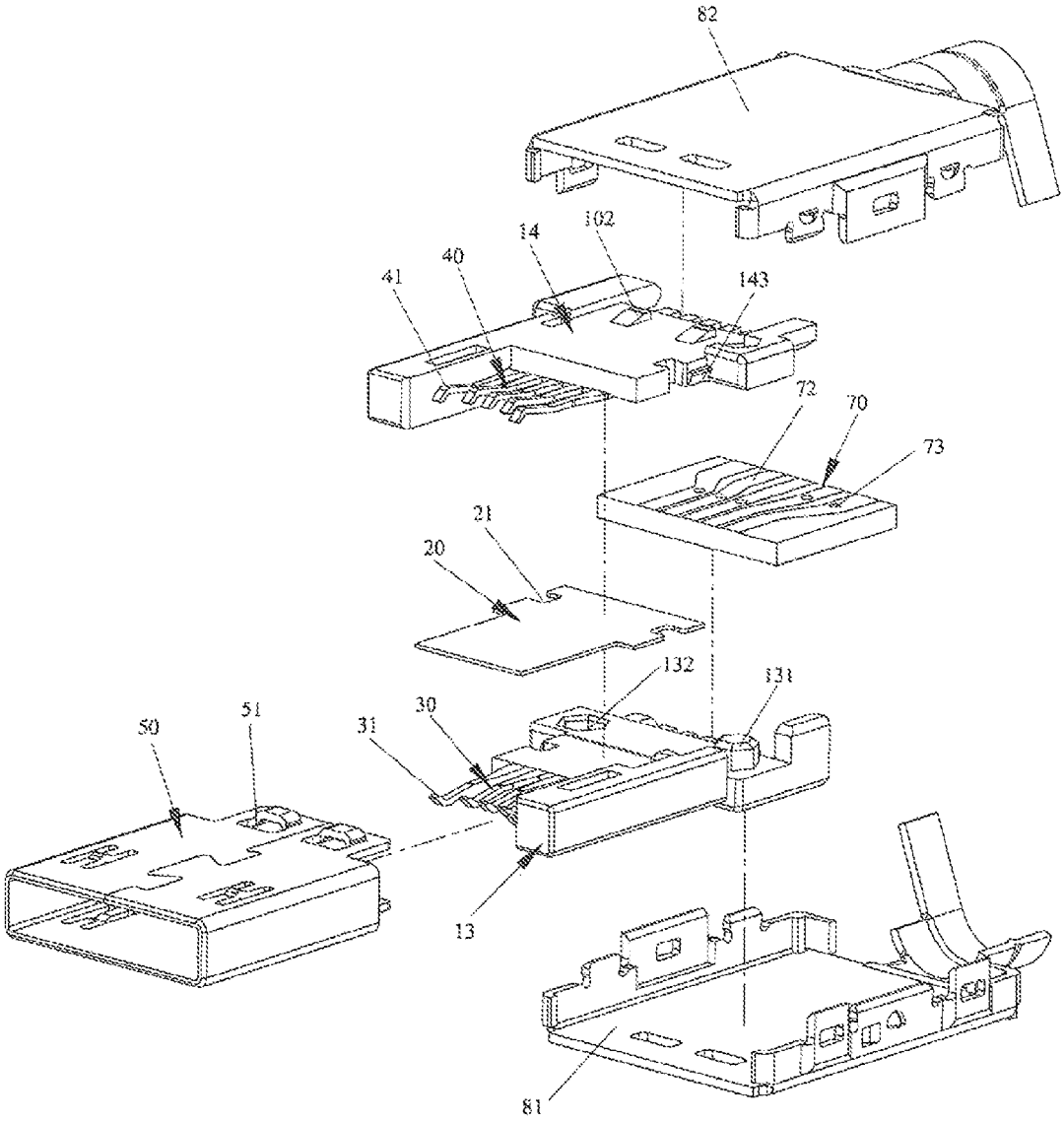
Figure 16:
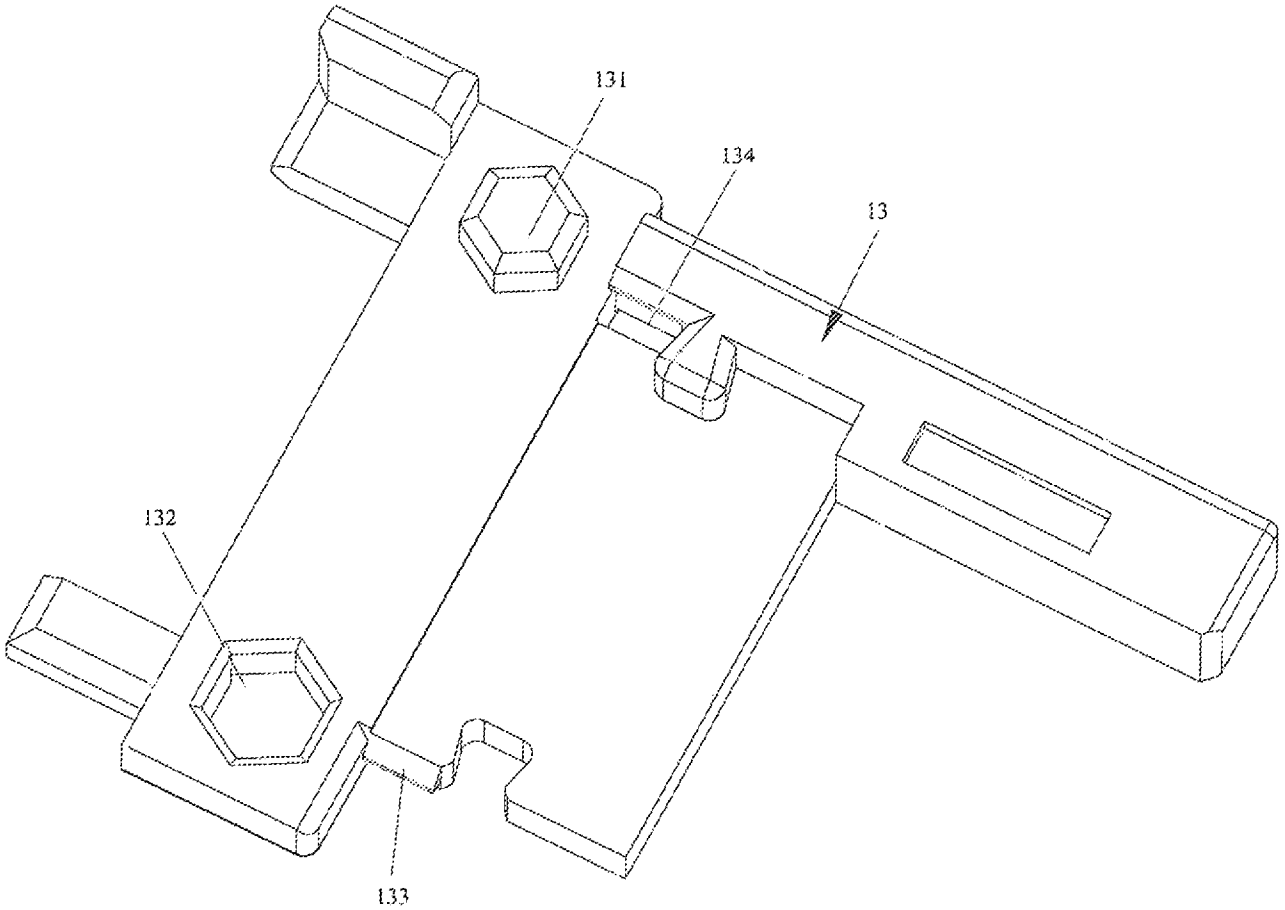
Figure 17:
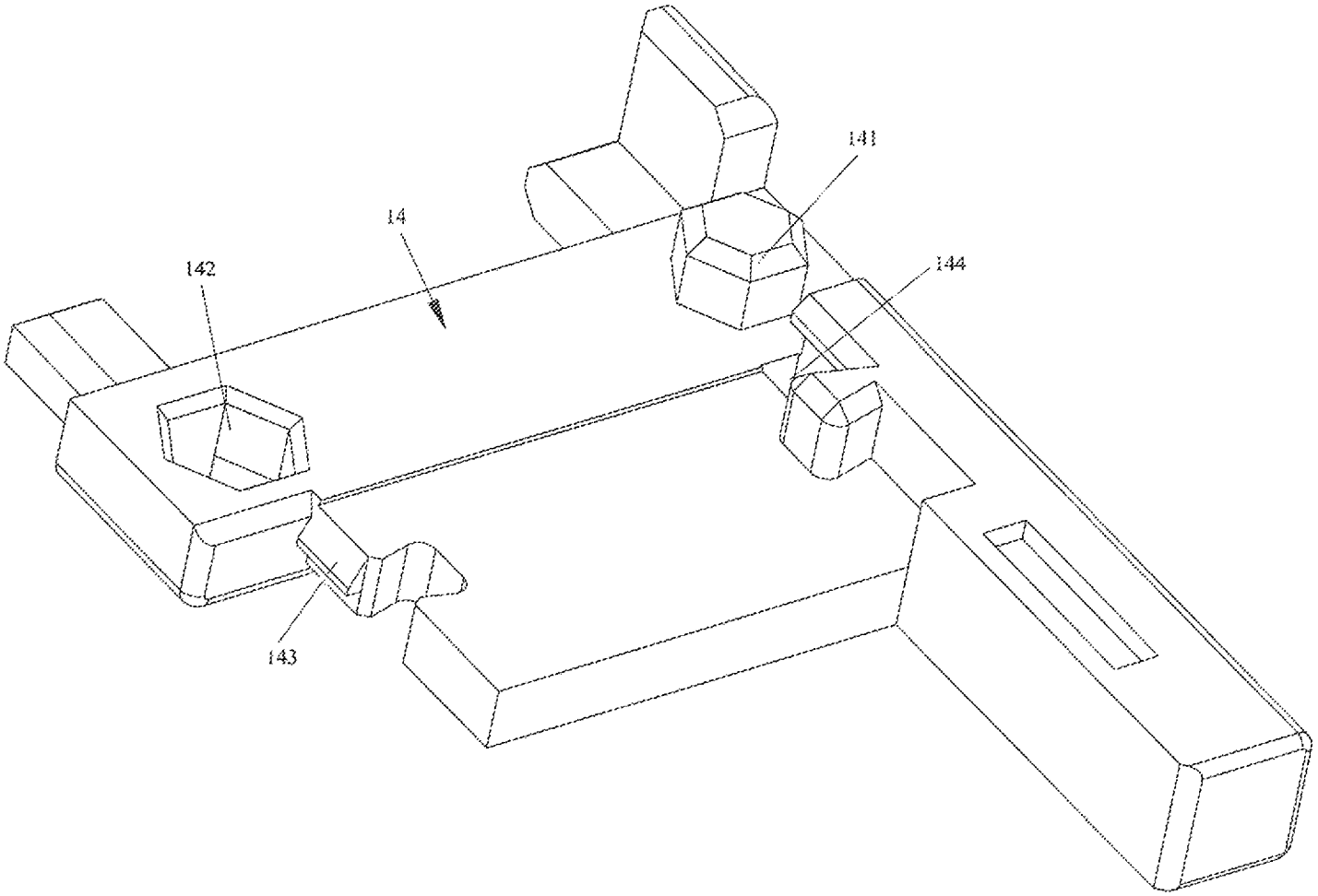
Figure 18:
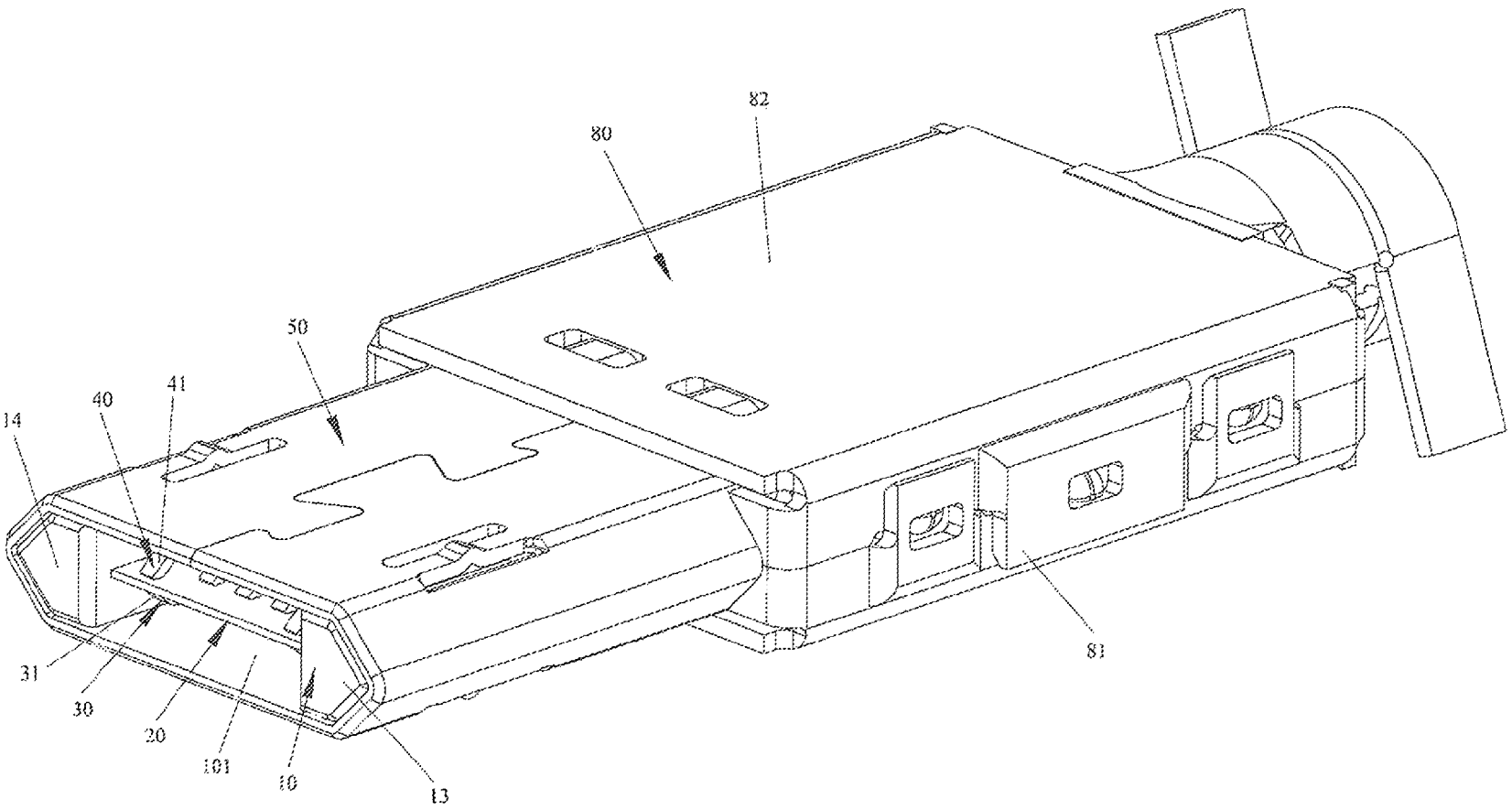
Figure 19:
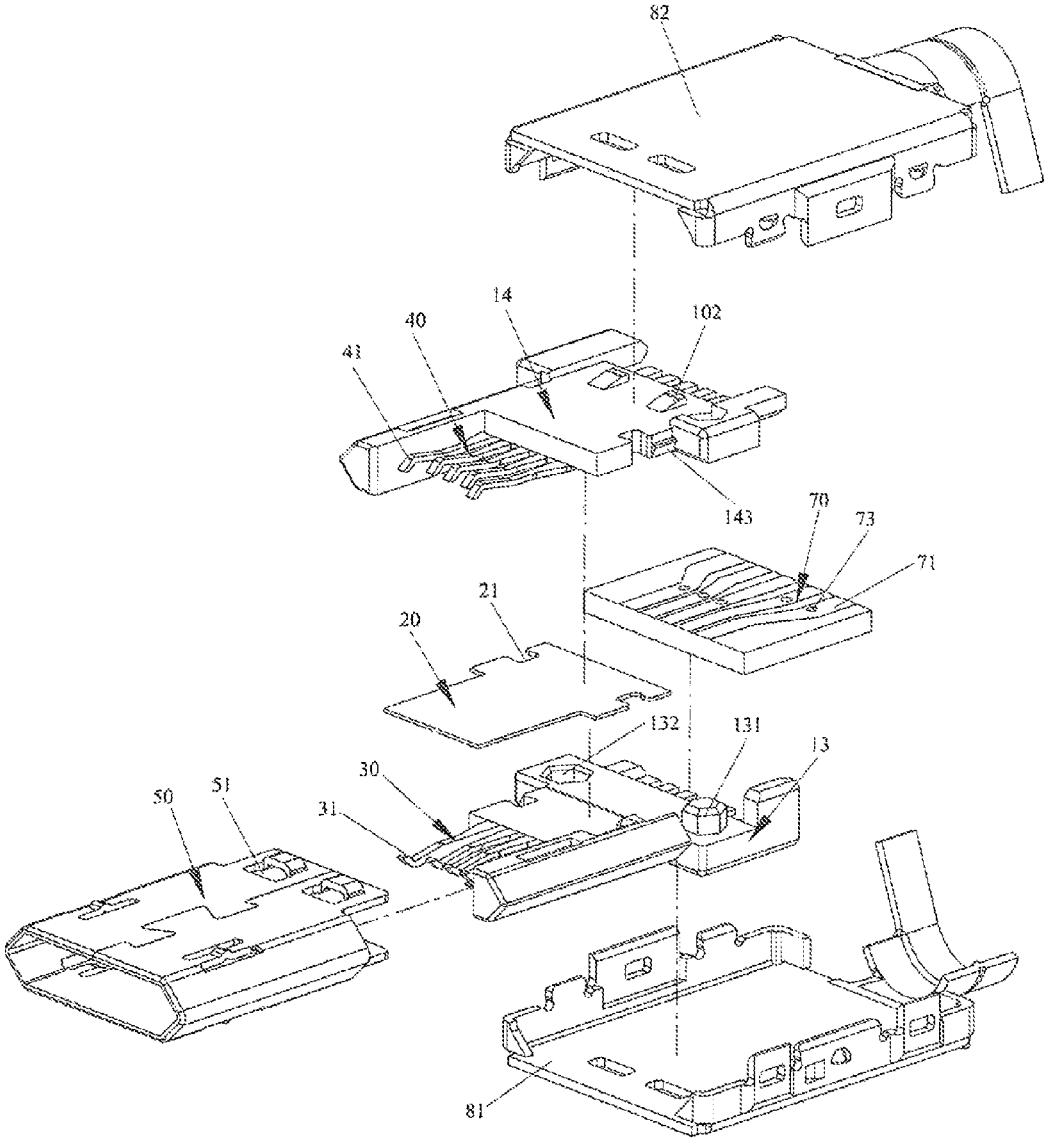
Figure 20:
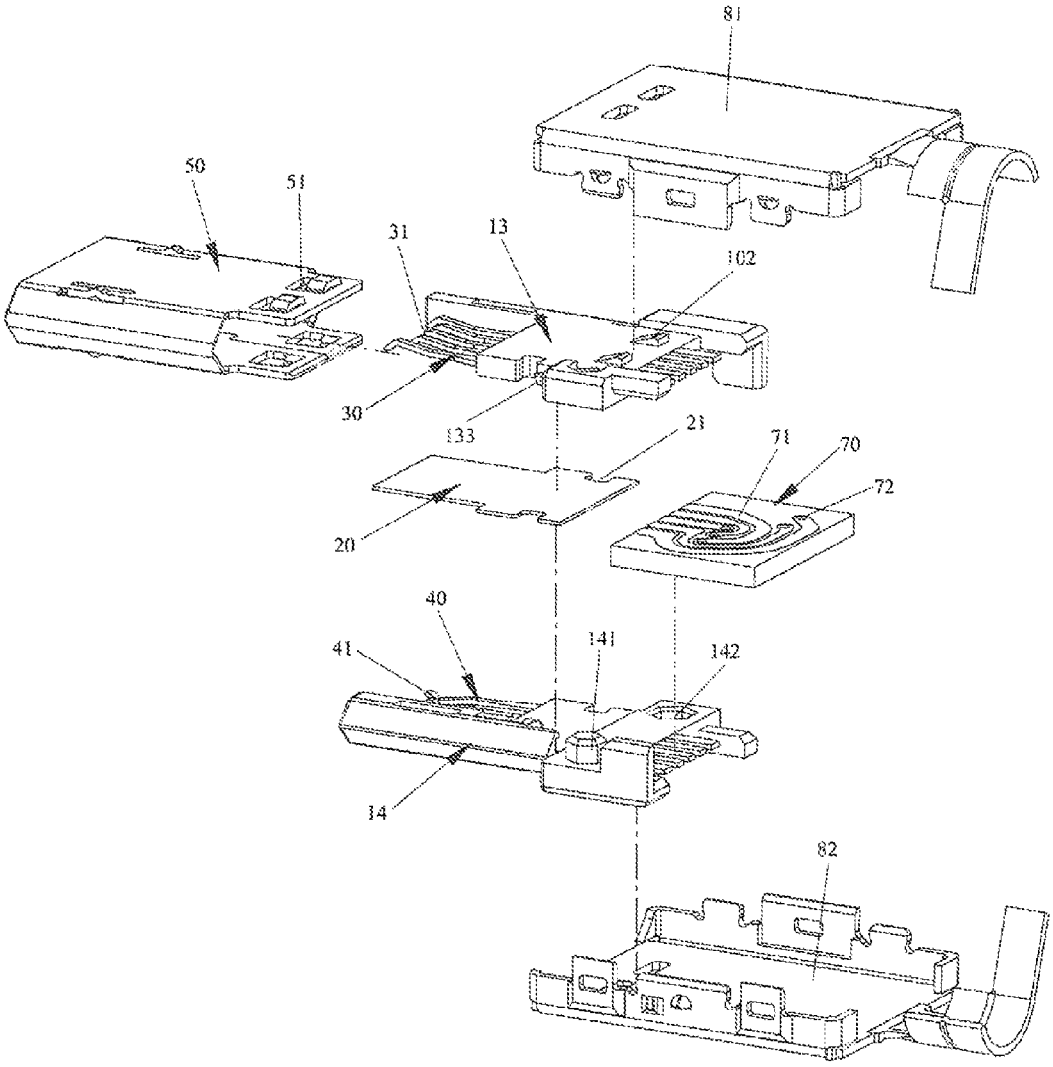

(51) Int. Cl.

| | |
|---|---|
| ***H01R 24/60*** | (2011.01) |
| *H01R 27/00* | (2006.01) |
| *H01R 107/00* | (2006.01) |

(56) References Cited

U.S. PATENT DOCUMENTS

| | | | | |
|---|---|---|---|---|
| 7,878,833 | B2 * | 2/2011 | Chen | H01R 13/5045 439/284 |
| 8,568,172 | B1 * | 10/2013 | Lan | H01R 12/57 439/607.4 |
| 8,573,995 | B2 * | 11/2013 | Golko | H01R 13/516 439/218 |
| 9,252,547 | B2 * | 2/2016 | Sun | H01R 24/62 |
| 9,281,582 | B2 * | 3/2016 | Hou | H01R 12/707 |
| 9,450,337 | B2 * | 9/2016 | Kao | H01R 13/6461 |
| 2010/0248544 | A1 * | 9/2010 | Xu | H01R 13/6658 439/607.04 |
| 2015/0072562 | A1 * | 3/2015 | Little | H01R 13/6658 439/607.55 |

* cited by examiner

POWER PLUG CONNECTOR CAN BE PLUGGED IN BOTH NORMAL AND REVERSE WAY

FIELD OF TECHNOLOGY

The utility model involves connector technology field, especially a power plug which can plug in both normal and reverse way.

BACKGROUND TECHNOLOGY

The power plug connector and the power socket connector are two connecters that work with each other and realize power and data transmission. Power plug connector is widely used in cell phone data line and used as cell phone charger and data input and output.

The current standard power socket connector's tongue plate is a plastic body which is integrally formed on the insulator. The distance between the upper surface of the tongue plate and the inner surface upon the shield case is different from the distance between the lower surface of the tongue plate and the inner surface under the shield case. However, the current power plug connector's tongue plate is an extension from the insulator. The power plug connector's tongue plate is hard plastic board, therefore, when the current power plug connector connects with the power socket connector, the Normal plugging can only be used, otherwise, the power plug connector is not able to be inserted. So, it has brought lots of inconveniences to people's daily use and it usually brings wear or even damage during multiple reverse insertion.

Therefore, it needs to work out a new technical scheme to solve the above problem.

Utility Model Content

In view of the deficiency of the existing technology, the main purpose of the utility model is to provide a power plug connector which can be plugged normally and reversely. And the utility model can effectively solve the problem that the existing power plug connector cannot be plugged reversely, has inconveniences in use, and often damages the connector.

In order to realize the above purpose, the utility model adopts the following technical scheme:

A power plug connector which can be plugged normally and reversely comprises:

An insulator, the front-end of the insulator is arranged with slot;

A soft tongue plate, the rear-end of the soft tongue plate is fixed upon the insulator and the front-end is suspended inside the slot;

Multiple first terminals, those multiple first terminals are arranged on the insulator side by side on left and right with intervals. The first contact part of those multiple first terminals are all located on the surface of the soft tongue plate;

Multiple second terminals, those multiple second terminals are arranged on the insulator side by side on left and right with intervals. And the second contact part of those multiple second terminals are all located in the bottom surface of the soft tongue plate. The multiple second terminals are in opposite arrangement direction with the multiple first terminals, and every rear-end of the second terminals are connected with the corresponding rear-end of the first terminals respectively;

A shielding case, the insulator is covered by the shielding case;

When inserting in normal way, the first contact part of the multiple first terminal are electrically connected with the contacts of the external socket connector. When inserting in reverse way, the front-end of the soft tongue plate, the front-end of multiple first terminals and the front-end of multiple second terminals all bent downwards. The second contact part of the second terminals is electrically connected with the terminal of the external socket connector.

As an optimized scheme, the rear-ends of the foresaid first terminals are bending and extending out a push and contact part. Every push and contact part of the first terminals push against the corresponding rear-ends of the second terminals to conduct and connect. Those second terminals are extended backwards forming a welding part. And the welding part is exposed outside the insulator As an optimized scheme, the foresaid insulator comprises a lower insulating piece and a upper insulating piece, the upper insulating piece is installed upon the lower insulating piece. The foresaid multiple first terminals are fixed with the upper insulating piece by enchase molding and the foresaid multiple second terminals are fixed with the lower insulating piece enchase molding.

As an optimized scheme, the surface of the lower insulating piece's rear-end is provided with a concave embedded slot and the upper insulating piece is embedded in the slot.

As an optimized scheme, the front-end edge of the foresaid embedded slot is provided with a convex catching stick. Correspondingly, the rear-end of the soft tongue plate is provided with a first catching groove, and the front-end of the upper insulating piece is provided with a second catching groove. The catching stick is placed in the first catching groove and the second catching groove. And the soft tongue plate's rear-end is tightly clamped between the upper insulating piece and the lower insulating piece.

As an optimized scheme, the foresaid embedded slot's rear-end is placed with a catching groove. Correspondingly, the rear-end edge of the upper insulating piece is placed with a convex catching part. And the catching groove and catching part are mutually fixed with each other.

As an optimized scheme, the foresaid second terminals' rear-ends are respectively connected with the first terminals' rear-ends through printed circuit board (PCB).

As an optimized scheme, the PCB is placed at rear-end of the insulator. The PCB surface is printed with many first circuits. The foresaid first multiple terminals are electrically connected with corresponding first circuits. The PCB bottom surface is printed with many second circuits. The foresaid second multiple terminals are electrically connected with corresponding second circuits, and such circuit board is arranged with many via holes. Those via holes are respectively conducted and connected between the corresponding first circuits and second circuits.

As an optimized scheme, the foresaid insulator contains first insulating piece and second insulating piece. The first insulating piece and second insulating piece are all presented in "L" shape. The foresaid multiple first terminals are fixed with the first insulating piece by enchase molding. The first insulating piece and the second insulating piece are opposite to each other and overlapped in vertical direction; it further includes a rear shielding case which covers the insulating piece's rear-end and PCB. The rear shielding case comprises an upper case and a lower case. The upper case and the lower case are structurally the same. The upper case and lower case are interlocked with each and fixed together.

As an optimized scheme, the first insulating piece is provided, with a first locating stick and a first locating hole. The second locating stick and the second locating hole are arranged upon the second insulating piece. The second locating stick is inserted into the first locating hole; and the first locating stick is inserted into the second locating hole. And, the first insulating piece is provided with a first catching part and a first catching groove; the second insulating piece is provided with a second catching part and a second catching groove. The first catching part is locked and fixed with the second catching groove. The second catching part is locked and fixed with the first catching groove.

The utility model has obvious advantages and beneficial effects. Specifically, it can be seen from the above technical scheme:

I. By fixing the soft tongue upon the insulator, the front-end of the soft tongue is suspended inside the insertion slot. It replaces the traditional unibody setting method which is set upon the insulator, and it arranges multiple first terminals and multiple second terminals respectively upon and under the soft tongue plate, and it conducts by connecting between the rear-ends of the second terminals and the corresponding rear-ends of the first terminals. When plug normally, the product, like normal power plug connector, can be smoothly plugged-in with no obstacles, and multiple first terminals contacts the power socket connector and it conducts. When plug reversely, the soft tongue plate will bend which allows the product to continue inserting, so the multiple terminals can connect the power socket connector and conducts. By this, it really realizes the normal and reverse plugging, which brings conveniences to people's daily use and will not bring wear and damage to the connector.

II. Through a unibody which fixes the first terminal with upper insulating piece by enchase molding, a unibody which fixes the second terminal with lower insulating piece by enchase molding, the product is rugged structurally and easy to assemble.

III. Through arranging PCB on insulator and by using PCB to conduct and connect rear-ends of second terminals and corresponding rear-ends of first terminals, it enormously simplifies the structure of the first terminals and second terminals, which makes products manufacturing easier, benefits the productivity improvement, meanwhile, ensures the reliability and stability of the circuit connection.

In order to clearly explain the features and functions of the utility model, it will elaborate the utility model combined with attached drawings and exploit examples.

DESCRIPTION OF ATTACHED DRAWINGS

Drawing 1 is a 3D assembly sketch for the preferred exploit example No. 1 of the utility model;

Drawing 2 is a 3D assembly sketch from another angle for the preferred exploit example No. 1 of the utility model;

Drawing 3 is an exploded view for the preferred exploit example No. 1 of the utility model;

Drawing 4 is an exploded view from another angle for the preferred exploit example No. 1 of the utility model;

Drawing 5 is an enlarged view for the first terminal and second terminal of the preferred exploit example No. 1 of the utility model;

Drawing 6 is an enlarged view for the first terminal of the preferred exploit example No. 1 of the utility model;

Drawing 7 is 3D sketch for the preferred exploit example No. 1 under operational status of the utility model;

Drawing 8 is the section sketch for the preferred exploit example No. 1 of the utility model under the status of reverse plugging without full connection;

Drawing 9 is the section sketch for the preferred exploit example No. 1 of the utility model under the status of reverse plugging with full connection;

Drawing 10 is a 3D assembly sketch for the preferred exploit example No. 2 of the utility model;

Drawing 11 is an exploded view for the preferred exploit example No. 2 of the utility model;

Drawing 12 is 3D sketch for the preferred exploit example No. 2 under operational status of the utility model;

Drawing 13 is a 3D assembly sketch for the preferred exploit example No. 3 of the utility model;

Drawing 14 is an exploded view for the preferred exploit example No. 3 of the utility model;

Drawing 15 is an exploded view from another angle for the preferred exploit example No. 3 of the utility model;

Drawing 16 is an enlarged view for the first insulating piece of the preferred exploit example No. 3 of the utility model;

Drawing 17 is an enlarged view for the second insulating piece of the preferred exploit example No. 3 of the utility model;

Drawing 18 is a 3D assembly sketch for the preferred exploit example No. 4 of the utility model;

Drawing 19 is an exploded view for the preferred exploit example No. 4 of the utility model;

Drawing 20 is an exploded view from another angle for the preferred exploit example No. 4 of the utility model;

INSTRUCTION FOR MARKS OF ATTACHED DRAWINGS

10. Insulator
11. Upper insulating piece
12. Lower insulating piece
13. First insulating piece
131. First locating stick
132. First locating hole
133. First catching part
134. First catching groove
14. Second insulating piece
141. Second locating stick
142. Second locating stick
143. Second catching part
144. Second catching groove
101. Insertion slot
102. Catching part
103. Embedded slot
104. Catching stick
105. Second catching groove
106. Catching groove
107. Catching part
108. Groove
20. Soft tongue plate
21. First catching groove
30. First terminal
31. First contact part
32. Push and contact part
40. Second terminal
41. Second contact part
42. Welding part
50. Shielding case
51. Catching hole
60. Socket connector
70. PCB

71. First circuit
72. Second circuit
73. Via holes
80. Rear shielding case
81. Upper case
82. Lower case

SPECIFIC MODE OF EXECUTION

Please refer to Drawing 1 to Drawing 9, it shows the specific structure of the preferred exploit example No. 1 of the utility model, which comprises an insulator 10, a soft tongue plate 20, multiple first terminals 30, multiple second terminals 40 and a shielding case 50.

The front-end of the insulator 10 is arranged with insertion slot 101; the insertion slot 101 is used to be inserted by tongue plug of external socket. The rear-end of the of tongue plate 20 is fixed on the insulator 10 and the front-end of the soft tongue plate 20 is suspended inside the insertion slot 101.

Those multiple first terminals 30 are arranged side by side upon the insulator 10 on right and left with intervals. Those first contact parts 31 of the first terminal 30 are all arranged on the surface of the soft tongue plate 20.

Those multiple second terminals 40 are arranged side by side upon the insulator 10 on right and left with intervals. And the second contact part 41 of those multiple second terminals 40 are all located in the bottom surface of the soft tongue plate 20. The multiple second terminals 40 are in opposite arrangement direction with the multiple first terminals 30, and every rear-end of the second terminals 40 are connected with the corresponding rear-end of the first terminals 30 respectively; i.e. the rear-end of the second terminal 40 on the far left is connected with the rear-end of the first terminal 30 in far right, and the second rear-end of the second terminal 40 on the left is connected with the second rear-end of the first terminal 30 on the right, and so on.

The insulator 10 is covered by the shielding case 50, in this exploit example, the insulator 10 is arranged with a convex catching part 102. Correspondingly, the shielding case 50 is set with catching hole 51. The front-end of the insulator 10 is inserted from the rear opening of the shielding case 50, and the catching part 102 are interlocked and connected with the catching hole 51.

To be specific, in this exploit example, as is shown in Drawing 5 and Drawing 6, the rear-ends of the first terminal 30 are bending and extending out a push and contact part 32. Every push and contact part 32 of the first terminals 30 push against the corresponding rear-ends of the second terminals 40 to conduct and connect. Those second terminals 40 are extended backwards forming a welding part 42. The welding part 42 is used to electrically connect external cables through welding. And the welding part 42 is exposed outside the insulator 10.

And, as is shown in Drawing 3 and Drawing 4, the insulator 10 comprises a lower insulating piece 11 and an upper insulating piece 12, the upper insulating piece 12 is installed upon the lower insulating piece 11. The foresaid multiple first terminals 30 are fixed with the upper insulating piece 12 by enchase molding and the foresaid multiple second terminals 40 are fixed with the lower insulating piece 11 enchase molding. And the surface of the lower insulating piece's 11 rear-end is provided with a concave embedded slot 103 and the upper insulating piece 12 is embedded in the slot 103. Moreover, the front-end edge of the embedded slot 103 is provided with a convex catching stick 104. Correspondingly, the rear-end of the soil tongue plate 20 is provided with a first catching groove 21, and the front-end of the upper insulating piece 12 is provided with a second catching groove 105. The catching stick 104 is placed between the first catching groove 21 and the second catching groove 105 to avoid the soft tongue plate 20 and upper insulating piece 12 from moving back and forth. And the soft tongue plate's 20 rear-end is tightly clamped between the upper insulating piece 12 and the lower insulating piece 11. And, the embedded slot's 103 rear-end is provided with a catching groove 106. Correspondingly, the upper insulating piece's 12 rear-end edge is cambered outwards to form a catching part 107. The catching part 107 is interlocked with catching groove 106 and fixed together; In addition, the back surface of the embedded slot 103 is arranged with a groove 108. The rear-ends of second terminals are partly exposed in groove 108. The foresaid push and contact part 32 pushes against the second terminals 40 inside the groove 108 so as to connect and conduct.

In addition, two sides of the insulator's 10 rear-ends are all in vertical plane. Correspondingly, two sides of the shielding case 50 are also in vertical plane so as to match the structure of the external standard socket connector.

The detailed assembly process is as follows:

When assembling, firstly, form multiple first terminals 30 and second terminals 40 by punching press. Then, fix the first terminal 30 and upper insulating piece 12 together by enchasing molding, and fix the second terminal 40 and lower insulating piece 11 together by enchasing molding. Then, place soft tongue plate's 20 rear-end into the embedded slot 103, and suspend soft tongue plate's 20 front-end in to the insertion slot; next, insert upper insulating piece 12 into the embedded slot 103. By this, the push and contact part 32 of every first terminal 30 can push against the rear-end of the corresponding second terminal 40 and make them connect and conduct. At last, after the insulator 10 has been assembled, insert it from the rear-end of the shielding case 50 into proper place, making the catching part 102 connected with catching hole 51, thus the assembly is completed.

In this exploit example, the socket connector 60 is type A micro USB2.0 socket connector. Corresponding, the utility model's plug connector is also of type A. When plug normally, the utility model, like other plug connector, can be inserted into external socket connector 60 smoothly. And the multiple first terminal 30 are connected with all terminals inside the socket connector 60 to conduct. When plug reversely, as is shown in Drawing 8, the soft tongue 20 is slightly lower than the horizontal level of the tongue plate of socket connector 60. As is shown in Drawing 9, when it touches the tongue plate of the socket connector 60, it moves downwards, and after inserting to proper place, the soft tongue plate 20 bends to the maximum limit. At the moment, the multiple second terminals 40 realize connection with terminals inside the socket connector 60. When the when the utility model is pulled out, the soft tongue plate 20 immediately restores formation.

Please refer to Drawing 10 and Drawing 12, it shows the specific structure of the preferred exploit example No. 2 of the utility model. The exploit example is similar with the foresaid exploit example No. 1 structurally, and the difference lies in:

In this exploit example, the plug connector of the utility model is type B, so the corresponding socket connector 60 is type B micro USB2.0 socket connector. The left and right sides of the insulator's 10 front-end is of triangular prism structure. Correspondingly, the left and right sides of the shielding case 50 is also of triangular prism structure so as to match with another external standard socket connect.

The assembly method and usage of the exploit example is the same with the assembly method and usage of the foresaid preferred exploit example No. 1. Therefore, it will not elaborate the assembly method and usage in this exploit example.

Please refer to Drawing 13 and Drawing 17, it shows the specific structure of the utility model's preferred exploit example No. 3. The specific structure of the exploit example is similar with the foresaid preferred exploit example No. 1 and the difference is:

In this example, all rear-ends of second terminals 40 are respectively connected with the rear-ends of the corresponding first terminals 30 through PCB 70. Specifically, in this example, the PCB 70 is arranged on rear-end of the insulator 10. The surface of the PCB 70 is formed with multiple first circuits 71. The foresaid first terminals 30 are electrically connected with corresponding first circuits 71 respectively. The bottom surface of the PCB 70 is formed with multiple second circuits 72. The foresaid second terminals 40 are electrically connected with corresponding second circuits 72 respectively. And the PCB 70 is provided with multiple via holes 73. Those multiple via holes 73 are respectively conducted and connected between the corresponding first circuits 71 and second circuits 72.

And, the insulator 10 contains first insulating piece 13 and second insulating piece 14. The first insulating piece 13 and second insulating piece 14 are all presented in "L" shape. The foresaid multiple first terminals 30 are fixed with the first insulating piece 13 by enchase molding. The foresaid multiple second terminals 40 are fixed with the second insulating piece 14. The first insulating piece 13 and the second insulating piece 14 are opposite to each other and overlapped in vertical direction.

Specifically, the first insulating piece 13 is provided with a first locating stick 131 and a first locating hole 132. The second locating stick 141 and the second locating hole 142 are arranged upon the second insulating piece 14. The second locating stick 132 is inserted into the first locating hole 141; and the first locating stick 131 is inserted into the second locating hole 142. And, the first insulating piece 13 is provided with a first catching part 133 and a first catching groove 134; the second insulating piece 14 is provided with a second catching part 143 and a second catching groove 144. The first catching part 133 is locked and fixed with the second catching groove 144. The second catching part 143 is locked and fixed with the first catching groove 134. So, the first insulating piece 13 can be assembled together with the second insulating piece 14 and form insulator 10.

In addition, it further includes a rear shielding case 80 which covers the insulating piece's 10 rear-end and PCB 70. The rear shielding case 80 comprises an upper case 81 and a lower case 82. The upper case 81 and lower case 82 are interlocked with each and fixed together. The upper case 81 and the lower case 82 are structurally the same. Therefore, the two cases are able to interlock each other and reduce the cost for molding.

The detailed assembly process is as follows:

When assembling, firstly, form multiple first terminals 30 and second terminals 40 by punching press. Then, fix the first terminal 30 and first insulating piece 13 together by enchasing molding and fix the second terminal 40 and second insulating piece 14 together by enchasing molding. Then, assemble the first insulating piece 13 together with the insulating piece 14 and form insulator 10. Meanwhile, place PCB 70 between rear-end of the first insulating piece 13 and rear-end of the second insulating piece 14. At this moment, all rear-end of the first terminal 30 are electrically connected with the corresponding first circuit 71. All rear-end of the second terminal 48 are electrically connected with the corresponding second circuit 72. And it adopts welding method to fix the rear-end of first terminal 30 with corresponding first circuit 71, and fix the rear-end of the second terminal 30 with corresponding second circuit 72. Then, insert the insulator 10 after assembling into the f the rear opening of the shielding case 50, and enable the catching part 102 to be interlocked and connected with the catching hole 51. Finally, interlock the upper case 81 and lower case 82 to cover the insulator's 10 rear-end and the PCB 70 to finish the assembly.

The usage of the exploit example is the same with that of the foresaid preferred exploit example No. 1 Therefore, it will not elaborate the usage in this exploit example.

Please refer to Drawing 18 and Drawing 20, which show the specific structure of the preferred exploit example No. 4 of the utility model. The exploit example is similar with the foresaid exploit example No. 3 structurally, and the difference lies in:

In this exploit example, the plug connector of the utility model is type B, so the corresponding socket connector 60 is type B micro USB2.0 socket connector. The left and right sides of the insulator's 10 front-end is of triangular prism structure. Correspondingly, the left and right sides of the shielding case 50 is also of triangular prism structure so as to match with another external standard socket connect.

The design key of the utility model is in that firstly, by fixing the soft tongue upon the insulator, the front-end of the soft tongue is suspended inside the insertion slot. It replaces the traditional unibody setting method which is set upon the insulator, and it arranges multiple first terminals and multiple second terminals respectively upon and under the soft tongue plate, and it conducts by connecting between the rear-ends of the second terminals and the corresponding rear-ends of the first terminals. When plug normally, the product, like normal power plug connector, can be smoothly plugged-in with no obstacles, and multiple first terminals contacts the power socket connector and it conducts. When plug reversely, the soft tongue plate will bend which allows the product to continue inserting, so the multiple terminals can connect the power socket connector and conducts. By this it really realizes the normal and reverse plugging, which brings conveniences to people's daily use and will not bring wear and damage to the connector. Secondly, Through a unibody which fixes the first terminal with upper insulating piece by enchase molding, a unibody which fixes the second terminal with lower insulating piece by enchase molding, the product is rugged structurally and easy to assemble. Thirdly, through arranging PCB on insulator and by using PCB to conduct and connect rear-ends of second terminals and corresponding rear-ends of first terminals, it enormously simplifies the structure of the first terminals and second terminals, which makes products manufacturing easier, benefits the productivity improvement, meanwhile, ensures the reliability and stability of the circuit connection.

The above is only the preferred exploit examples of the utility model, and it does not restrict the technical scope of the utility model. Therefore, any minor modification, equivalent change and the modification to the above exploit examples based on the substance of the utility model still belong to the technical scheme scope of the utility model.

I claim:

1. A power plug connector which can be plugged in both normal and reverse way, comprising:

an insulator having a groove arranged at a front end thereof;

a soft tongue plate having a rear end thereof fixed upon the insulator and a front end thereof suspended inside the groove;

a plurality of first terminals arranged on the insulator side by side on left and right with intervals and having first contact parts located on a surface of the soft tongue plate;

a plurality of second terminals arranged on the insulator side by side on left and right with intervals and having second contact parts located in a bottom surface of the soft tongue plate; the second terminals arranged opposite to the first terminals, and the rear end of the second terminals being connected with the rear end of the first terminals; and a shielding case covering the insulator;

wherein the rear end of the first terminals includes an adjoining part bending and extending therefrom; the adjoining part of the first terminals pushes against and connects with the corresponding the rear end of the second terminals; the second terminals includes welding parts disposed at the rear end thereof and extending therefrom; the welding part is exposed outside the insulator;

when the power plug connector is inserted in normal way, wherein the first contact parts of the first terminals are electrically connected with terminals of an external socket connector; when the power plug connector is inserted in reverse way, wherein the front end of the soft tongue plate, and front ends of the first terminals and the second terminals bent downwardly; wherein the second contact parts of the second terminals are electrically connected with the terminals of the external socket connector.

2. The power plug connector which can be plugged in both normal and reverse way according to claim 1, wherein the insulator comprises a lower insulating piece and an upper insulating piece; the upper insulating piece is installed upon the lower insulating piece; the first terminals are fixed with the upper insulating piece, and the second terminals are fixed with the lower insulating piece.

3. The power plug connector which can be plugged in both normal and reverse way according to claim 2, wherein the lower insulating piece is provided with a slot disposed at a rear end thereof; the upper insulating piece is embedded in the slot.

4. The power plug connector which can be plugged in both normal and reverse way according to claim 3, wherein the slot is provided with convex parts disposed at a front edge thereof; the soft tongue plate is provided with first grooves disposed correspondingly to the convex parts, and the upper insulating piece is provided with second grooves disposed at a front end thereof; the convex parts are embedded in the first grooves and the second grooves, and the rear end of the soft tongue plate is tightly clamped between the upper insulating piece and the lower insulating piece.

5. The power plug connector which can be plugged in both normal and reverse way according to claim 4, wherein the slot includes concave parts disposed at a rear end thereof; the upper insulating piece includes protruding parts disposed at a rear edge thereof; the concave part and the protruding parts are mutually fixed with each other.

6. The power plug connector which can be plugged in both normal and reverse way according to claim 1, wherein the rear ends of second terminals are respectively connected with the rear ends of the first terminals through a printed circuit board (PCB).

7. The power plug connector which can be plugged in both normal and reverse way according to claim 6, wherein the PCB is placed at a rear end of the insulator, and includes a plurality of first circuits printed on an upper surface thereof and electrically connected with the corresponding first terminals; a plurality of second circuits disposed in a bottom surface thereof and electrically connected with the corresponding second terminals; and a plurality of through holes disposed thereon and respectively connected between the corresponding first circuits and second circuits.

8. The power plug connector which can be plugged in both normal and reverse way according to claim 1, wherein the insulator includes a first insulating piece and a second insulating piece; the first insulating piece and second insulating piece are presented in "L" shape; the first terminals are fixed with the first insulating piece and the second terminals are fixed with the second insulating piece; the first insulating piece and the second insulating piece are opposite to each other and overlapped in vertical direction; the insulator further includes a rear shielding case configured to cover the rear end of the insulating piece and the PCB; the rear shielding case includes an upper case and a lower case; the upper case and the lower case have the same structures and are coupled to each other.

9. The power plug connector which can be plugged in both normal and reverse way according to claim 8, wherein the first insulating piece includes a first locating stick and a first locating hole; the second insulating piece includes a second locating stick and a second locating hole; the second locating stick is inserted into the first locating hole, and the first locating stick is inserted into the second locating hole; the first insulating piece is provided with a first catching part and a first catching groove; the second insulating piece is provided with a second catching part and a second catching groove; the first catching part is locked and fixed with the second catching groove, and the second catching part is locked and fixed with the first catching groove.

* * * * *